US007789721B1

(12) United States Patent
Burdenko et al.

(10) Patent No.: US 7,789,721 B1
(45) Date of Patent: Sep. 7, 2010

(54) ELECTRICAL CONNECTOR AND METHOD OF MAKING SAME

(75) Inventors: Michael N. Burdenko, Welles Hills, MA (US); Dennis C. Mackey, Hamilton, MA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 12/420,736

(22) Filed: Apr. 8, 2009

(51) Int. Cl.
*H01R 13/11* (2006.01)

(52) U.S. Cl. ..... 439/851; 439/857

(58) Field of Classification Search ..... 439/320, 439/321, 851–854, 856–857
See application file for complete search history.

(56) References Cited

U.S. PATENT DOCUMENTS

| | | | | |
|---|---|---|---|---|
| 2,700,144 | A | 1/1955 | Flanagan, Jr. | |
| 3,059,208 | A | 10/1962 | Concelman | |
| 3,812,452 | A * | 5/1974 | Sturm | 439/857 |
| 4,205,889 | A * | 6/1980 | Rieman | 439/82 |
| 4,990,105 | A | 2/1991 | Karlovich | |
| 5,123,864 | A | 6/1992 | Karlovich | |
| 6,126,487 | A | 10/2000 | Rosenberger | |
| 6,250,974 | B1 | 6/2001 | Kerek | |
| 6,761,054 | B2 * | 7/2004 | Andersen | 72/331 |
| 6,899,572 | B1 | 5/2005 | Baker et al. | |
| 6,955,569 | B2 | 10/2005 | Baker et al. | |
| 7,467,980 | B2 * | 12/2008 | Chiu | 439/843 |

* cited by examiner

*Primary Examiner*—Khiem Nguyen
(74) *Attorney, Agent, or Firm*—Fletcher Yoder LLP; William R. Walbrun; John M. Miller

(57) ABSTRACT

An electrical connector is provided. The electrical connector includes a socket housing and a plurality of socket contacts disposed within the socket housing. Each of the plurality of socket contacts comprises a body and at least two members extending from the body towards a pin-receiving end and separated by longitudinal slots. Each of the members has a tapered cross-section thicker towards an end adjacent to the body than towards a distal end through which the socket contact receives a mating pin.

15 Claims, 3 Drawing Sheets

ELECTRICAL CONNECTOR AND METHOD OF MAKING SAME

BACKGROUND

The invention relates generally to electrical connectors, and particularly to a socket contact for receiving a mating pin in an electrical connector.

Various types of electrical connectors are known and are in use in devices such as sensors, electrical power supplies and circuit boards. For example, an electrical connector having a socket contact and a mating pin may be employed to provide electrical contacts in such devices. In certain electrical connectors, the socket contact may include two socket leaves to receive the mating pin within the socket contact. Typically, a substantially high contact force is applied during assembly of the electrical connector to minimize electrical resistance, thereby inducing high stresses in the socket leaves. In general, proper socket operation occurs below a yield point of the socket material. However, tight manufacturing tolerances may be required for the parts of the connector to maintain stresses within the connector below a yield point of the socket material. As a result, costs of manufacturing of such electrical connectors may be substantial.

Typically, the electrical connectors may be formed with tight manufacturing tolerances to account for the deflection of the socket leaves. Further, in certain electrical connectors, specially formulated alloys may be employed for the socket material to ensure that the stresses are maintained within the yield limit of the material. In certain other electrical connectors, a contact force applied to the connector is adjusted to limit the deflection of the socket contact. However, such connectors with lower contact forces may have reduced thermal performance and may not be suitable for certain applications.

Accordingly, it would be desirable to develop an electrical connector that delivers high clamping force while maintaining stresses in the connector within the yield limit. It would be advantageous to provide a socket contact that enables the stresses in the socket to be within a yield limit of the socket material regardless of the tolerance stack-up of the electrical connector.

BRIEF DESCRIPTION

Briefly, according to one embodiment of the present invention, an electrical connector is provided. The electrical connector includes a socket housing and a plurality of socket contacts disposed within the socket housing, wherein each of the plurality of socket contacts comprises a body and at least two members extending from the body towards a pin-receiving end and separated by longitudinal slots, each of the members having a tapered cross-section thicker towards an end adjacent to the body than towards a distal end through which the socket contact receives a mating pin.

In accordance with another aspect, a socket contact for an electrical connector is provided. The socket contact includes a first member and a second member disposed opposite to the first member to receive a mating pin therebetween. The walls of the first and second members are bent to form an opening to receive the mating pin. The first and second members are configured to expand outwardly to conform to the mating pin within the socket contact.

In accordance with another aspect, a method of forming an electrical connector is provided. The method includes forming first and second tapered members of a socket contact extending from a socket body and bending the first and second members towards one another at a first end of the socket contact. The method also includes coupling connection leads to a second end of the socket contact and disposing the socket contact with the first and second tapered members within a socket housing.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in detail below, embodiments of the present technique function to provide an electrical connector having pin and socket electrical contacts such as employed in cord sets for various applications. In particular, the present technique employs socket contacts with a tapered configuration to engage a mating pin within a respective socket contact.

Figure 1:
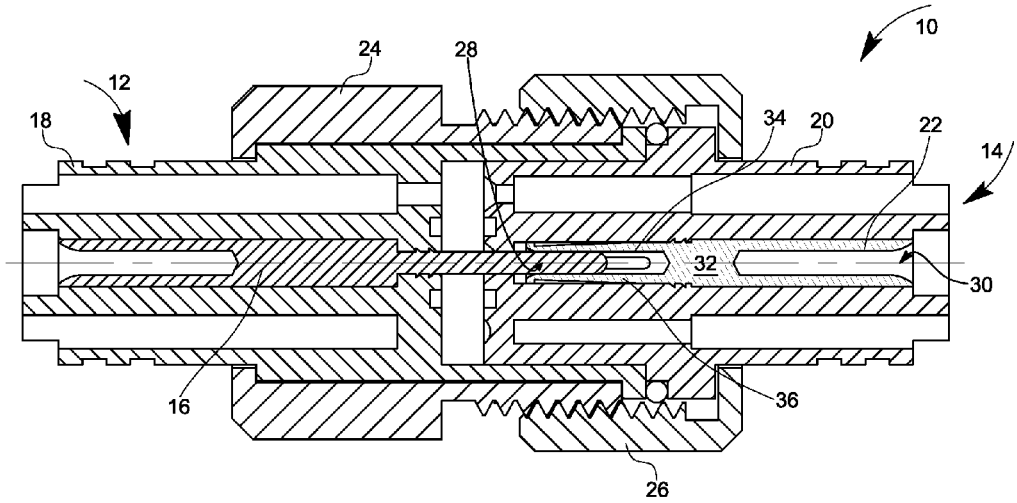
FIG. 1 is a cross-sectional view of an assembled configuration of an electrical connector in accordance with aspects of the present technique.

Turning now to drawings and referring first to FIG. 1, a cross-sectional view of an assembled configuration of an electrical connector 10 is provided. The electrical connector 10 includes a pin connector 12 and a socket connector 14. The pin connector 12 may include a plurality of pins such as represented by reference numeral 16, disposed within a housing 18. The number of pins 16 employed in the pin connector 12 is based upon a type of application where the electrical connector 10 may be employed. In certain embodiments, the pin connector 12 may include between 2 and 6 pins, although many more pins and sockets may be provided for some applications. In one exemplary embodiment, the housing 18 includes molded polyvinyl chloride (PVC) and the plurality of pins 16 include gold plated brass or bronze contacts.

The socket connector 14 includes a socket housing 20 and a plurality of socket contacts, such as represented by reference numeral 22, disposed within the socket housing 20. The number of the socket contacts 22 is based upon a corresponding number of mating pins 16 of the pin connector 12. In certain embodiments, each of the plurality of socket contacts 22 comprises brass, or beryllium copper, or phosphor bronze. In one exemplary embodiment, the socket housing 20 includes molded polyvinyl chloride (PVC). It should be noted that the particular layout, pattern, and size of the pins and socket contacts may vary depending upon the application, and pins and socket contacts of different sizes may be provided in the same connector.

In this exemplary embodiment, the pin connector 12 is coupled to the socket connector 14 through a threaded coupling 24 and a coupling nut 26. However, other coupling mechanisms may be envisaged. In the illustrated embodiment, each of the plurality of socket contacts 22 includes a tapered configuration to receive the mating pin 16 within a respective socket contact 22 through a first end 28. Further connection leads (not shown) are coupled to a second end 30 of the socket contact 22 for coupling the socket connector 14 to an external device such as a distribution box (not shown). In a similar manner, conductors routed to each side of the connector may be placed in electrical contact with one another. It should also be noted that in certain configurations, pins only may be provided in one side of the connector, with socket contacts only in the other side. However, some configurations may utilize pins and socket contacts in some locations in one of the connector halves, with socket contacts and pins in complementary locations of the mating connector half.

Figure 2:
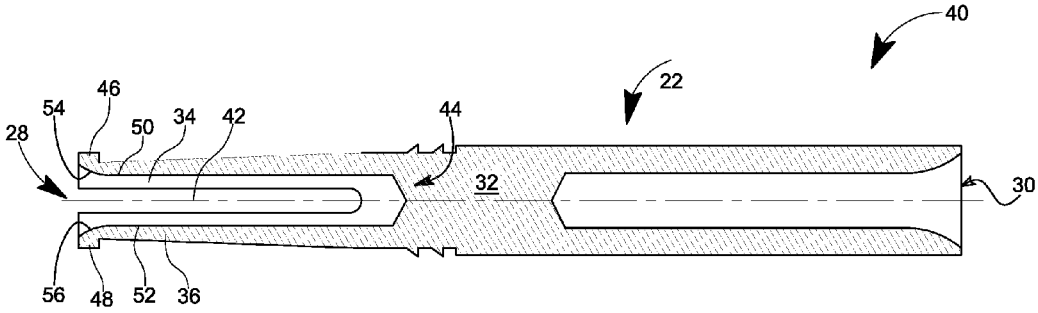
FIG. 2 is a cross-sectional view of the socket contact of FIG. 1.

In a presently contemplated configuration, the socket contact 22 includes a body 32 and at least two members 34 and 36 extending from the body 32. FIG. 2 is a cross-sectional view 40 of the socket contact 22 of FIG. 1. As illustrated, the socket contact includes at least two members 34 and 36 extending from the body 32 towards the pin-receiving end 28 and separated by a longitudinal slot 42. Each of the members 34 and 36 has a tapered cross-section thicker towards an end 44 adjacent to the body 32 than towards the distal end 28 through which the socket contact 22 receives the mating pin 16 (see FIG. 1). In this exemplary configuration, the socket contact 22 includes two members 34 and 36. However, other configurations having socket contacts with more than two members may be envisaged.

In the illustrated embodiment, the two members 34 and 36 are configured to expand outwardly to align the mating pin 16 within the socket contact 22. In one exemplary configuration, the two members 34 and 36 include generally cone-shaped beams. Further, a cone angle of each of the beams 34 and 36 is selected to facilitate quasi-uniform strength bending of the beams 34 and 36. In certain embodiments, a taper angle of each of the two members 34 and 36 is based upon a variety of design parameters of the electrical connector 10. Examples of such parameters include a socket leaf cross section, length, desired deflection before yield, desired stress concentration limit, etc. In one exemplary embodiment, a taper angle of the each of the two members 34 and 36 is less than about 2 degrees (with respect to a line parallel to the central axis). In one exemplary embodiment, the taper angle of each of the two members 34 and 36 is between about 1.4 degrees and 1.8 degrees.

In certain exemplary embodiments, each of the two members 34 and 36 includes deflection-limiting extensions such as represented by reference numerals 46 and 48, thereof to limit deflection of the respective members 34 and 36 upon receiving the mating pin 16. It should be noted that surfaces 46 and 48 substantially prevent over bending of the members 34 and 36 by touching the housing 30. Further, the two members 34 and 36 may include chamfers 54 and 56 to lead the mating pin 16 within the socket contact 22. In certain embodiments, chamfer angles of the chamfers 54 and 56 are selected close to friction angles to facilitate engagement of the mating pin 16 within the socket contact. The two members 34 and 36 are bent (e.g., crimped) towards each other initially and are configured to expand outwardly to conform to the mating pin 16 within the socket contact 22.

Figure 3:
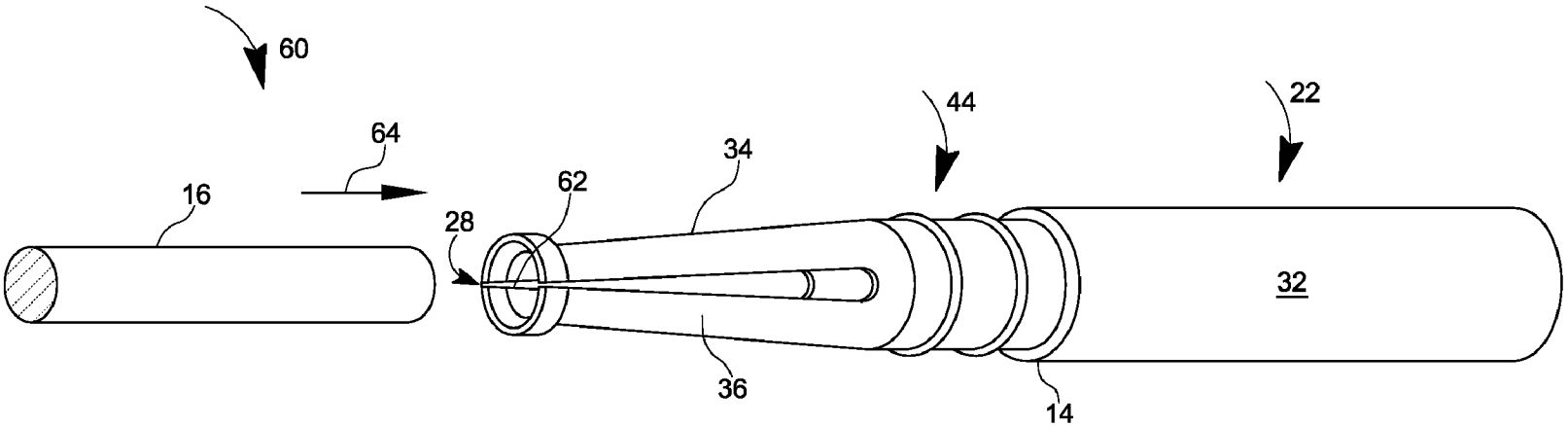
FIG. 3 is a perspective view of the socket contact of FIG. 2 with members bent towards each other at a pin-receiving end of the socket contact.

FIG. 3 is a perspective view 60 of the socket contact 22 with the members 34 and 36 bent towards each other at the pin-receiving end 28 of the socket contact 22. In operation, the two members 34 and 36 are crimped such that there is no gap between the two members 34 and 36. Once the pin 16 is inserted within the socket contact 22, the members 34 and 36 expand outwardly to form an opening to receive the mating pin 16.

As illustrated, the walls of the first and second members 34 and 36 are bent to form an opening 62 to receive the mating pin 16. As can be seen, each of the members 34 and 36 has a tapered cross-section thicker towards the end 44 adjacent to the body 32 than towards the distal end 28 through which the socket contact 22 receives the mating pin 16. It should be noted that the tapered cross-section of the first and second members 34 and 36 facilitates a quasi-uniform strength bending of the first and second members 34 and 36. In particular, the bending stresses due to deflections of the first and second members 34 and 36 by insertion of the pin 16 within the socket contact 22 are maintained below the yield limit of the material. As a result, a variety of alloys may be employed for the socket contact 22 while maintaining a desired manufacturing yield.

Figure 4:
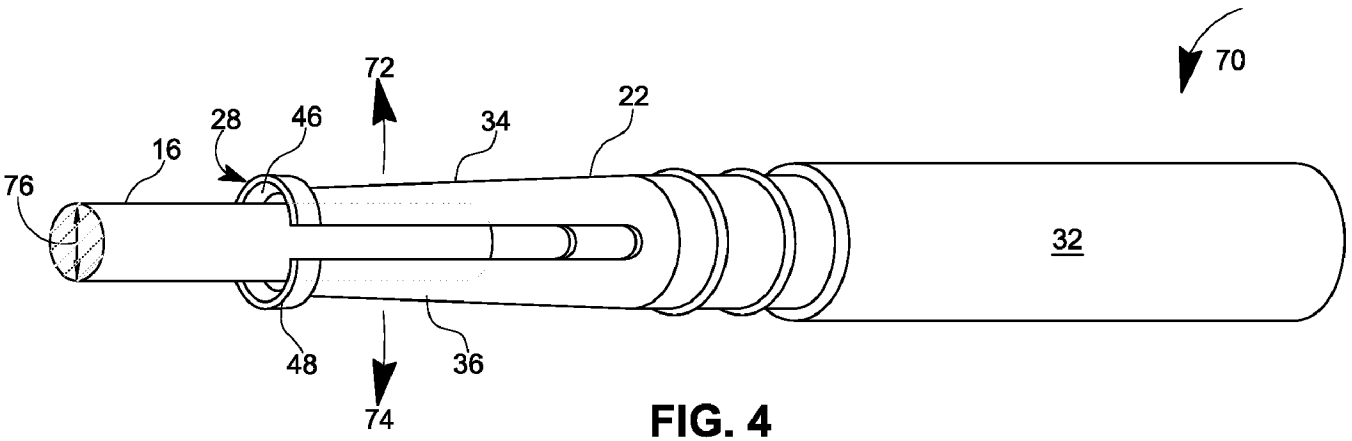
FIG. 4 is a perspective view of an assembled configuration of the socket contact and a mating pin.

The pin 16 is inserted in a direction 64 from the pin-receiving end 28. The first and second members 34 and 36 are configured to elastically deform to engage the pin 16 within the socket contact 22. FIG. 4 is a perspective view of an assembled configuration 70 of the socket contact 22 and the pin 16. As illustrated, once the pin 16 is inserted through the pin-receiving end 28, the two members 34 and 36 expand outwardly in directions 72 and 74 respectively to conform to a pin diameter 76.

As described above, the tapered cross-section of the two members 34 and 36 facilitates distributing resulting bending stresses across a length of the socket contact 22. This reduces any stress concentration within the socket contact 22 thereby substantially improving reliability of the socket contact and connector, and the robustness of the electrical connection. Further, the deflection-limiting extensions 46 and 48 limit the deflection of the respective members 34 and 36 upon receiving the mating pin 16 and prevents the members 34 and 36 from accidental over bending by touching the housing 32.

Figure 5:
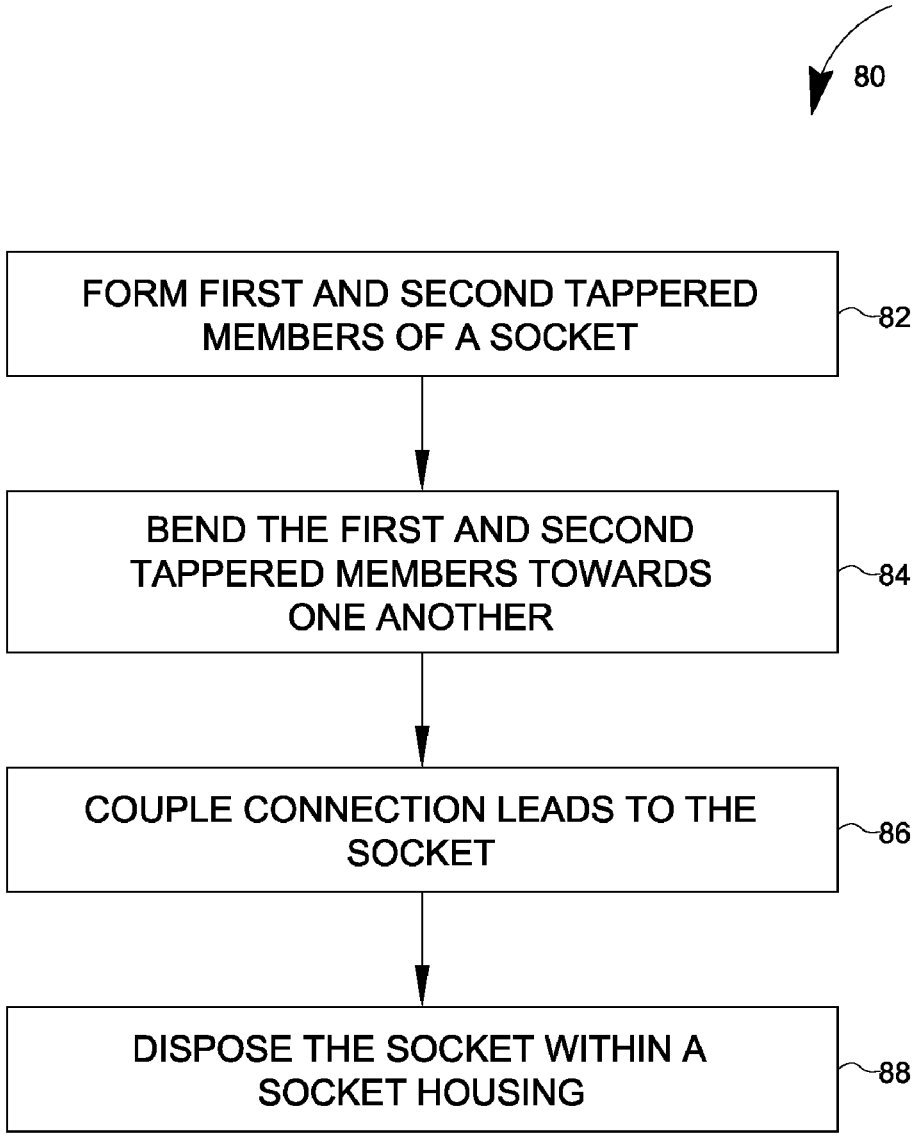
FIG. 5 is a flow chart illustrating an exemplary method of forming the socket contact of FIG. 1 for in accordance with aspects of the present technique.

FIG. 5 is a flow chart illustrating an exemplary method 80 of forming the socket contact 22 of FIG. 1 in accordance with aspects of the present technique. At step 82, first and second tapered members of a socket contact are formed. The first and second tapered members extend from a socket body and are separated from one another through longitudinal slots. Each of the first and second tapered members has a cross-section that is thicker towards an end adjacent to the body than towards a distal end through which the socket contact receives the mating pin. The first and second tapered members include, in a presently contemplated embodiment, brass, beryllium copper, or phosphor bronze, or combinations thereof, although other materials, may be utilized.

The first and second tapered members may be formed using conventional machining processes such as laser machining. In certain embodiments, a taper angle of each of the first and second tapered members is less than about 2 degrees. In one embodiment, the first and second tapered members comprise generally conical beams. In certain embodiments, a cone angle of the conical beams may be selected to facilitate quasi-uniform strength bending of the beams.

At step 84, the first and second members are bent towards one another at a first end of the socket contact. Further, connection leads are coupled to a second end of the socket contact (step 86). Such connection leads may be employed to couple the electrical connector to an external device such as an external distribution box or other application or component. At step 88, the socket contact with the first and second tapered members is disposed within a socket housing.

The various aspects of the structures and methods described hereinabove have utility in electrical connectors, used in various applications. As described above, the socket contact employed in the electrical connector has at least two tapered members to conform to a mating pin within the socket contact. The technique facilitates quasi-uniform strength bending of the two members and substantially reduces stress concentration in the socket contact. Advantageously, this configuration enables the stresses in the socket contact to be within a yield limit of the socket material regardless of the tolerance stack-up of the pin/socket assembly.

Furthermore, this technique enables use of a wide variety of alloys to be utilized for socket material while maintaining desirable manufacturing yields. Thus, the technique described above facilitates forming reliable and robust electrical connections while reducing the manufacturing costs. Moreover, the technique may be employed to form effective electrical connectors for sensitive small current applications and internet applications as well as harsh environment applications such as environments subjected to severe vibrations.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An electrical connector, comprising:

a socket housing; and a plurality of socket contacts disposed within the socket housing, wherein each of the plurality of socket contacts comprises a body and at least two members extending from the body towards a pin-receiving end and separated by longitudinal slots, each of the members having a tapered cross-section thicker towards an end adjacent to the body than towards a distal end through which the socket contact receives a mating pin and wherein the at least two members comprise generally right cylindrical interior surfaces and right conical exterior surfaces.

2. The electrical connector of claim 1, wherein each of the at least two members are configured to expand outwardly to conform to the mating pin within the socket contact.

3. The electrical connector of claim 2, wherein outer walls of the at least two members are tapered along a length of the socket contact.

4. The electrical connector of claim 3, wherein each of the members defines a cone angle.

5. The electrical connector of claim 1, wherein a taper angle of each of the at least two members is less than about 2 degrees.

6. The electrical connector of claim 5, wherein the taper angle of each of the at least two members is between about 1.4 degrees and about 1.8 degrees.

7. The electrical connector of claim 1, wherein each of the plurality of socket contacts comprises brass, beryllium copper, or phosphor bronze, or combinations thereof.

8. The electrical connector of claim 1, wherein each of the at least two members comprises a deflection-limiting extension on an outer surface thereof to limit deflection of the respective member upon receiving the mating pin.

9. The electrical connector of claim 4, wherein the cone angle is selected to facilitate quasi-uniform strength bending of the beams.

10. An electrical connector, comprising:

a socket housing; and a plurality of socket contacts disposed within the socket housing, wherein each of the plurality of socket contacts comprises a body and at least two members extending from the body towards a pin-receiving end and separated by longitudinal slots, each of the members having a tapered cross-section thicker towards an end adjacent to the body than towards a distal end through which the socket contact receives a mating pin and wherein a taper angle of each of the at least two members is less than about 2 degrees.

11. The electrical connector of claim 10, wherein each of the at least two members are configured to expand outwardly to conform to the mating pin within the socket contact.

12. The electrical connector of claim 10, wherein a cone angle of each of the beams is selected to facilitate quasi-uniform strength bending of the beams.

13. The electrical connector of claim 10, wherein the taper angle of each of the at least two members is between about 1.4 degrees and about 1.8 degrees.

14. The electrical connector of claim 10, wherein each of the plurality of socket contacts comprises brass, beryllium copper, or phosphor bronze, or combinations thereof.

15. The electrical connector of claim 10, wherein each of the at least two members comprises a deflection-limiting extension on an outer surface thereof to limit deflection of the respective member upon receiving the mating pin.

* * * * *